US011386859B2

(12) United States Patent
Wu

(10) Patent No.: US 11,386,859 B2
(45) Date of Patent: Jul. 12, 2022

(54) POLARITY COMPENSATION DEVICE AND METHOD

(71) Applicant: HIMAX TECHNOLOGIES LIMITED, Tainan (TW)

(72) Inventor: Tung-Ying Wu, Tainan (TW)

(73) Assignee: HIMAX TECHNOLOGIES LIMITED, Tainan (TW)

( * ) Notice: Subject to any disclaimer, the term of this patent is extended or adjusted under 35 U.S.C. 154(b) by 0 days.

(21) Appl. No.: 16/952,031

(22) Filed: Nov. 18, 2020

(65) Prior Publication Data

US 2022/0157270 A1 May 19, 2022

(51) Int. Cl.
*G09G 3/36* (2006.01)

(52) U.S. Cl.
CPC ..... *G09G 3/3614* (2013.01); *G09G 3/3648* (2013.01); *G09G 2300/0439* (2013.01); *G09G 2320/0223* (2013.01); *G09G 2320/0233* (2013.01); *G09G 2320/0271* (2013.01); *G09G 2320/0295* (2013.01)

(58) Field of Classification Search
CPC ..... G09G 3/3614; G09G 3/3648; G09G 2300/0439; G09G 2320/0223; G09G 2320/0233; G09G 2320/0242; G09G 2320/0252; G09G 2320/0257; G09G 2320/0271; G09G 2320/029; G09G 2320/0295; G09G 2320/04
See application file for complete search history.

(56) References Cited

U.S. PATENT DOCUMENTS

2006/0214897 A1* 9/2006 Murai ..... G09G 3/3648 345/89
2017/0287418 A1* 10/2017 Hwang ..... G09G 3/3607
2021/0097947 A1* 4/2021 Liu ..... G09G 3/3607

FOREIGN PATENT DOCUMENTS

CN 109712580 5/2019
TW 200620235 6/2006

OTHER PUBLICATIONS

"Office Action of Taiwan Counterpart Application", dated Sep. 22, 2021, p. 1-p. 4.

* cited by examiner

*Primary Examiner* — David Tung
(74) *Attorney, Agent, or Firm* — JCIPRNET

(57) ABSTRACT

A polarity compensation device and a polarity compensation method are provided. The polarity compensation device includes a variance calculation circuit and a compensation calculation circuit. The variance calculation circuit calculates a difference value between current sub-pixel data and previous sub-pixel data in the same frame period, wherein the current sub-pixel data and the previous sub-pixel data belong to the same data line of a display panel. The compensation calculation circuit converts the difference value into a function value. The compensation calculation circuit decides to increase or decrease the current sub-pixel data by the function value according to a polarity corresponding to the same frame period, so as to generate compensated sub-pixel data.

7 Claims, 4 Drawing Sheets

POLARITY COMPENSATION DEVICE AND METHOD

BACKGROUND

Technical Field

The disclosure relates to a display apparatus, and in particular to a polarity compensation device and method.

Description of Related Art

In order to avoid damages to the properties of liquid crystal molecules, a source driver drives a display panel in a polarity inversion mode. In the event that a charging time is short, a line sticking issue may arise in the display panel. For instance, when a large-size display panel with high-resolution displays a checkerboard test pattern, line sticking may occur at a junction between black and white squares. One of the reasons for line sticking rests in that a charging capability of a sub-pixel circuit of the display panel with a positive polarity is weak, while the charging capability of the sub-pixel circuit with a negative polarity is strong. Certainly, the issue of line sticking may also occur if the charging capability of the sub-pixel circuit with the positive polarity is strong and the charging capability of the sub-pixel circuit with the negative polarity is weak.

FIG. 1 is a schematic diagram illustrating a circuit block of a sub-pixel circuit SPU of a conventional display panel 100. The display panel 100 shown in FIG. 1 includes a plurality of data lines (or source lines, such as a data line SL shown in FIG. 1), a plurality of scan lines (or gate lines, such as a scan line GL shown in FIG. 1), and a plurality of sub-pixel circuits (such as a sub-pixel circuit SPU shown in FIG. 1). The sub-pixel circuit SPU includes a thin film transistor (TFT) SW1 and other elements (not shown). When the scan line GL turns on the TFT SW1, a driving voltage of the data line SL can be charged into the sub-pixel circuit SPU through the TFT SW1.

However, a gate-source voltage (Vgs) of the TFT SW1 with the positive polarity may be different from the gate-source voltage of the TFT SW1 with the negative polarity. The positive polarity means that a driving voltage Vs of the data line SL is greater than a common voltage Vcom. The negative polarity means that the driving voltage Vs of the data line SL is less than the common voltage Vcom. Here, it is assumed that the common voltage Vcom is 10 volts, which indicates that the driving voltage of "grayscale 255" is 18 volts and 2 volts in case of the positive polarity and the negative polarity, respectively. It is also assumed that a scan voltage Vg of the scan line GL is 28 volts when the scan line GL is being scanned. Therefore, the gate-source voltage of the TFT SW1 with the positive polarity is Vg-Vs=28−18=10 volts, and the gate-source voltage of the TFT SW1 with the negative polarity is Vg-Vs=28−2=26 volts. Generally, the greater the gate-source voltage of the transistor, the greater the current flowing through the transistor. Apparently, the sub-pixel circuit SPU with the positive polarity has a weak charging ability, while the sub-pixel circuit SPU with the negative polarity has a strong charging ability. The charging capacity in case of the positive polarity does not match the charging capacity in case of negative polarity, which may lead to the line sticking issue.

The information disclosed in this Background section is only for enhancement of understanding of the background of the described technology and therefore it may contain information that does not form the related art that is already known to a person of ordinary skill in the art. Further, the information disclosed in the Background section does not mean that one or more problems to be resolved by one or more embodiments provided herein was acknowledged by a person of ordinary skill in the art.

SUMMARY

The disclosure provides a polarity compensation device and a polarity compensation method to eliminate line sticking as much as possible.

In an embodiment of the disclosure, a polarity compensation device includes a variance calculation circuit and a compensation calculation circuit. The variance calculation circuit is configured to calculate a difference value between current sub-pixel data and previous sub-pixel data in the same frame period, wherein the current sub-pixel data and the previous sub-pixel data belong to the same data line of a display panel. The compensation calculation circuit is coupled to the variance calculation circuit to receive the difference value. The compensation calculation circuit is configured to convert the difference value to a function value. The compensation calculation circuit determines whether to increase or decrease the current sub-pixel data by the function value according to a polarity corresponding to the same frame period, so as to generate a compensated sub-pixel data.

In an embodiment of the disclosure, a polarity compensation method is provided. In the polarity compensation method, a difference value of current sub-pixel data and previous sub-pixel data is calculated by a variance calculation circuit in the same frame period, wherein, the current sub-pixel data and the previous sub-pixel data belong to the same data line of a display panel. The difference value is converted into a function value by a compensation calculation circuit. Whether to increase or decrease the current sub-pixel data by the function value is determined by the compensation calculation circuit according to a polarity corresponding to the same frame period to generate compensated sub-pixel data.

In light of the foregoing, in the polarity compensation device and the polarity compensation method described in one or more embodiments of the disclosure, the difference value of the current sub-pixel data the and previous sub-pixel data of the same data line may be calculated. According to the difference value and the polarity, the compensation calculation circuit may determine to increase or decrease the current sub-pixel data to generate the compensated sub-pixel data. Therefore, the polarity compensation device is able to eliminate line sticking as much as possible.

In order to make the disclosure more comprehensible, several embodiments accompanied with figures are described in detail below.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

DESCRIPTION OF THE EMBODIMENTS

Figure 1:
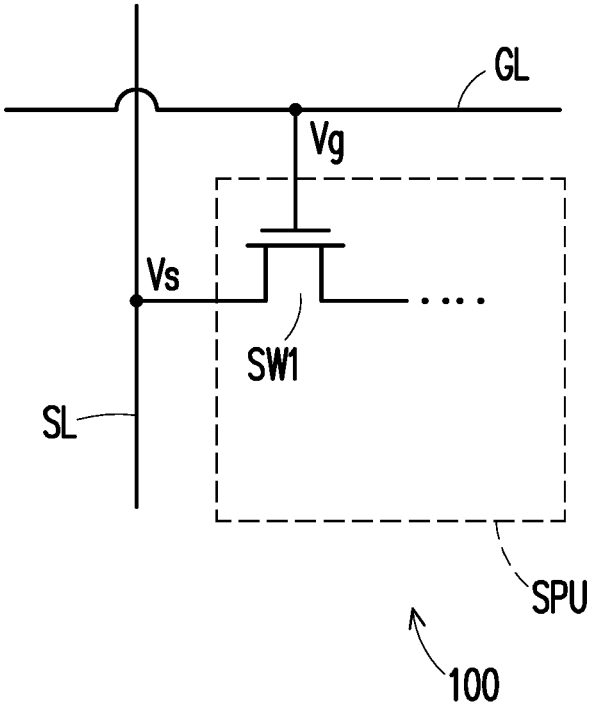
FIG. 1 is a schematic diagram illustrating a circuit block of a sub-pixel circuit of a conventional display panel.

The term "coupled to (or connected)" used in the entire specification of the disclosure (including the claims) may refer to any direct or indirect means of connection. For instance, if a first device is described as being coupled to (or connected to) a second device, it should be interpreted as that the first device can be directly connected to the second device, or the first device can be indirectly through other devices or some connection means to the second device. The terms "first" and "second" mentioned in the entire specification of the disclosure (including the claims) serve to name the elements or to distinguish different embodiments or ranges rather than posing a limitation on the upper or lower limit of the number of elements nor on the order of the elements. In addition, wherever possible, elements/components/steps marked by the same reference numbers in the drawings and embodiments represent the same or similar parts. The descriptions of elements/components/steps marked by the same reference numbers or terms in different embodiments may be cross-referenced.

Figure 2:
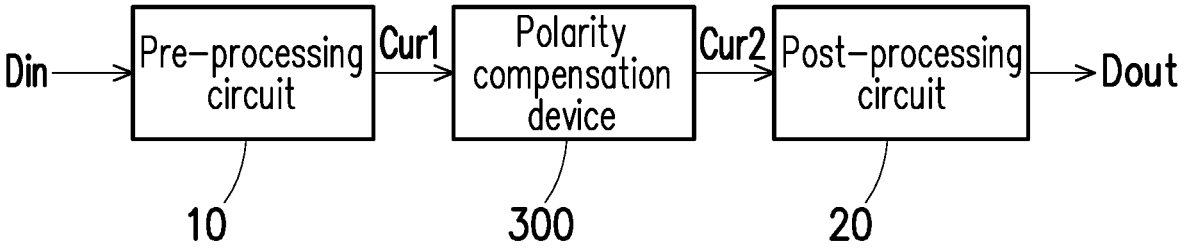
FIG. 2 is a schematic diagram illustrating a circuit block of a display apparatus according to an embodiment of the disclosure.

FIG. 2 is a schematic diagram illustrating a circuit block of a display apparatus according to an embodiment of the disclosure. The display apparatus shown in FIG. 2 includes a pre-processing circuit 10, a polarity compensation device 300, and a post-processing circuit 20. According to design requirements, the pre-processing circuit 10, the polarity compensation device 300, and the post-processing circuit 20 may be integrated into a timing controller. The pre-processing circuit 10 may process sub-pixel data Din to generate current sub-pixel data Cur1 to the polarity compensation device 300. For instance, the pre-processing circuit 10 may perform de-mura, line over driving (OD), and/or any other image processing operation on the sub-pixel data Din.

The polarity compensation device 300 is coupled to the pre-processing circuit 10 to receive the current sub-pixel data Cur1. The polarity compensation device 300 may calculate a difference value of the current sub-pixel data Cur1 and previous sub-pixel data of the same data line. According to the difference value and a polarity, the polarity compensation device 300 may increase or decrease the current sub-pixel data Cur1 to generate the compensated sub-pixel data Cur2. The polarity compensation device 300 may eliminate line sticking as much as possible.

The post-processing circuit 20 is coupled to the polarity compensation device 300 to receive the compensated sub-pixel data Cur2. The post-processing circuit 20 may process the compensated sub-pixel data Cur2 to generate sub-pixel data Dout to a source driver (not shown). For instance, the post-processing circuit 20 may perform dynamic gamma control (DGC), OD, dithering processing, and/or any other image processing operation on the compensated sub-pixel data Cur2.

Figure 3:
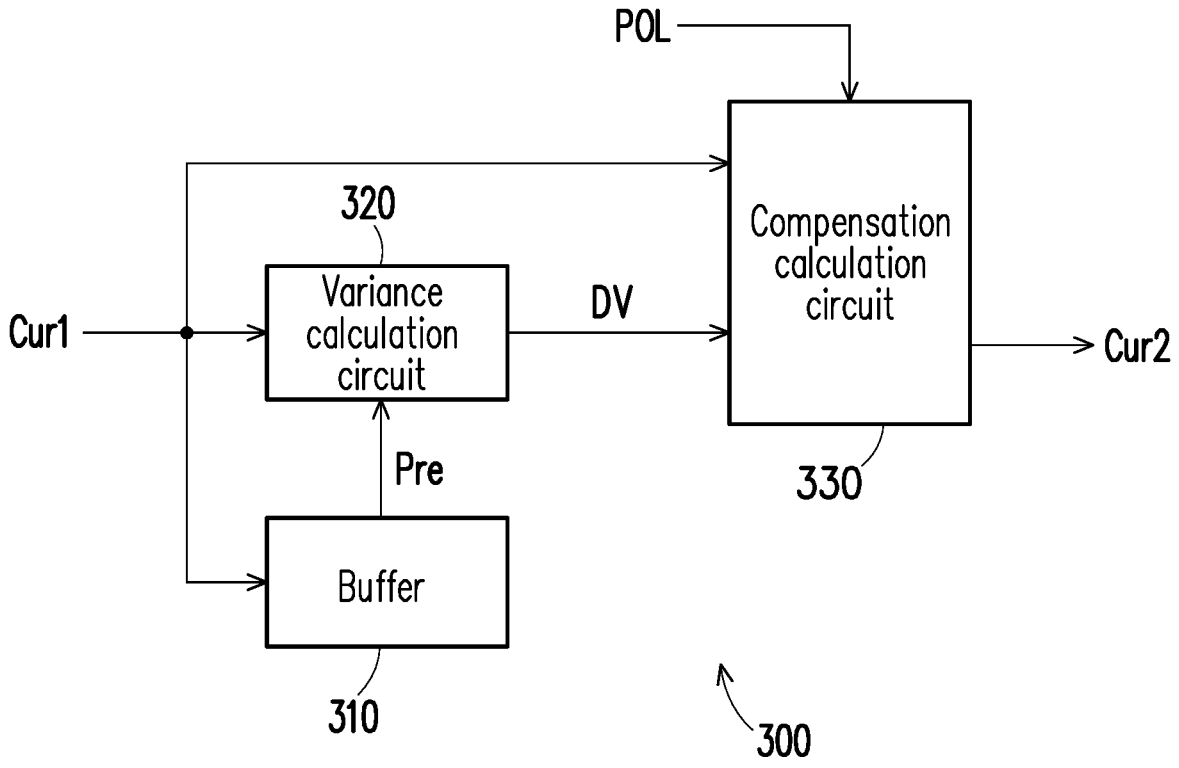
FIG. 3 is a schematic diagram illustrating a circuit block of the polarity compensation device shown in FIG. 2 according to an embodiment of the disclosure.

FIG. 3 is a schematic diagram illustrating a circuit block of the polarity compensation device 300 shown in FIG. 2 according to an embodiment of the disclosure. In the embodiment shown in FIG. 3, the polarity compensation device 300 includes a buffer 310, a variance calculation circuit 320, and a compensation calculation circuit 330. In the same frame period, the buffer 310 may temporarily store the current sub-pixel data Cur1 and provide the previous sub-pixel data Pre to the variance calculation circuit 320. Here, the current sub-pixel data Cur1 and the previous sub-pixel data Pre belong to the same data line of a display panel (not shown).

Figure 4:
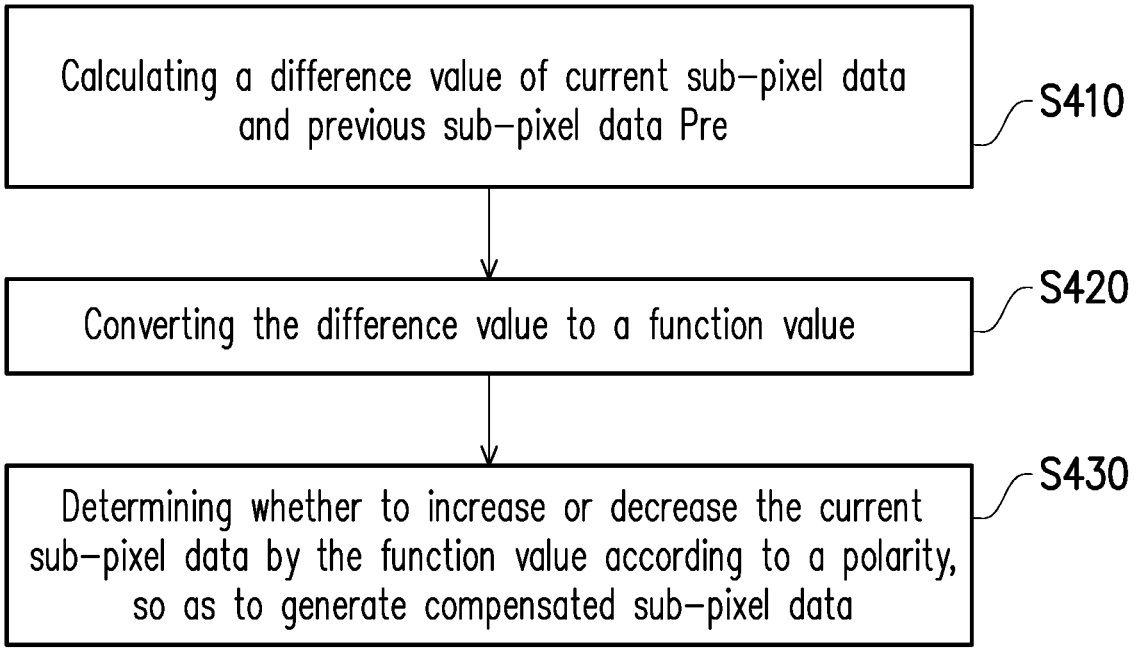
FIG. 4 is a schematic flowchart of a polarity compensation method according to an embodiment of the disclosure.

FIG. 4 is a schematic flowchart of a polarity compensation method according to an embodiment of the disclosure. With reference to FIG. 3 and FIG. 4, in step S410, a difference value DV of the current sub-pixel data Cur1 and the previous sub-pixel data Pre may be calculated by the variance calculation circuit 320 in the same frame period. For instance, the difference value DV may be |Cur1−Pre|. The compensation calculation circuit 330 is coupled to the variance calculation circuit 320 to receive the difference value DV. In step S420, the difference value DV may be converted to the function value FV by the compensation calculation circuit 330. For instance, in some embodiments, the compensation calculation circuit 330 may look up one or more look-up tables set according to design requirements by applying the difference value DV, so as to obtain the function value FV. In other embodiments, the compensation calculation circuit 330 may substitute the difference value DV into one or more equations defined according to design requirements to calculate the function value FV.

For instance, in some embodiments, the compensation calculation circuit 330 may in step S420 apply an equation 1 described below, so as to convert the difference value DV to the function value FV. In the equation 1, the difference value DV may be Cur1−Pre, and GLmax represents a grayscale resolution. If "8-bit sub-pixel data" are taken an example, the grayscale resolution GLmax is $2^8=256$.

$$FV=|DV|*|DV|/GL\max \quad \text{equation 1}$$

In some other embodiments, the compensation calculation circuit 330 may in step S420 apply an equation 2 described below to convert the difference value DV to the function value FV. In the equation 2, the difference value DV may be Cur1−Pre, GLmax represents the grayscale resolution, and W represents a weight. The weight W may be a fixed constant determined according to the design requirements. Alternatively, the weight W may be a dynamic value determined according to the design requirements. For instance, the compensation calculation circuit 330 may compare the current sub-pixel data Cur1 and the previous sub-pixel data Pre to obtain a variation relationship. The variation relationship includes "the current sub-pixel data Cur1 are greater than the previous sub-pixel data Pre" or "the current sub-pixel data Cur1 are less than the previous sub-pixel data Pre". The compensation calculation circuit 330 may know a polarity POL corresponding to the current frame period. The compensation calculation circuit 330 may dynamically adjust the weight W according to the polarity POL and the variation relationship.

$$FV=(|DV|*|DV|/GL\max)*W \quad \text{equation 2}$$

In still other embodiments, the compensation calculation circuit 330 may in step S420 apply an equation 3 provided below to convert the difference value DV to the function value FV. In the equation 3, the difference value DV may be Cur1−Pre, GLmax represents the grayscale resolution, and W represents the weight. The look-up value LT in the equation 3 may be obtained from a look-up table according to the difference value DV.

$$FV=(|DV|*|LT|/GL\ \max)*W \qquad \text{equation 3}$$

The look-up table may be defined according to the design requirements. For instance, in some embodiments, the look-up value LT in the equation 3 may be obtained from the following Table 1 according to the difference value DV.

TABLE 1

An example of the look-up table

| | | | | | | |
|---|---|---|---|---|---|---|
| DV | 0 | . . . | 16 | . . . | 254 | 255 |
| LT | 0 | . . . | 8 | . . . | 240 | 256 |

In step S430, according to a polarity corresponding to the same frame period, whether to increase or decrease the current sub-pixel data Cur1 by the function value FV is determined by the compensation calculation circuit 330, so as to generate the compensated sub-pixel data Cur2. For instance, for some display panels, the gate-source voltage Vgs of the TFT with the positive polarity may be lower than the gate-source voltage Vgs of the TFT with the negative polarity. Generally, the greater the gate-source voltage of the transistor, the greater the current flowing through the transistor (the stronger the charging capability). Therefore, if the polarity POL is expressed as the "positive polarity", and when the current sub-pixel data Cur1 are greater than (or equal to) the previous sub-pixel data Pre, the compensation calculation circuit 330 may increase the current sub-pixel data Cur1 by the function value FV to generate the compensated sub-pixel data Cur2 (i.e., Cur2=Cur1+FV). If the polarity POL is expressed as "positive polarity", and when the current sub-pixel data Cur1 are less than the previous sub-pixel data Pre, the compensation calculation circuit 330 may decrease the current sub-pixel data Cur1 by the function value FV to generate the compensated sub-pixel data Cur2 (i.e., Cur2=Cur1−FV). If the polarity POL is expressed as "negative polarity", and when the current sub-pixel data Cur1 are greater than (or equal to) the previous sub-pixel data Pre, the compensation calculation circuit 330 may decrease the current sub-pixel data Cur1 by the function value FV to generate the compensated sub-pixel data Cur2 (i.e., Cur2=Cur1−FV). If the polarity POL is expressed as "negative polarity", and when the current sub-pixel data Cur1 are less than the previous sub-pixel data Pre, the compensation calculation circuit 330 may increase the current sub-pixel data Cur1 by the function value FV to generate the compensated sub-pixel data Cur2 (i.e., Cur2=Cur1+FV).

For other display panels, the gate-source voltage Vgs of the TFT with the positive polarity may be greater than the gate-source voltage of the TFT with the negative polarity. Therefore, if the polarity POL is expressed as "positive polarity", and when the current sub-pixel data Cur1 are greater than (or equal to) the previous sub-pixel data Pre, the compensation calculation circuit 330 may decrease the current sub-pixel data Cur1 by the function value FV to generate the compensated sub-pixel data Cur2 (i.e., Cur2=Cur1−FV). If the polarity POL is expressed as "positive polarity", and when the current sub-pixel data Cur1 are less than the previous sub-pixel data Pre, the compensation calculation circuit 330 may increase the current sub-pixel data Cur1 by the function value FV to generate the compensated sub-pixel data Cur2 (i.e., Cur2=Cur1+FV). If the polarity POL is expressed as "negative polarity", and when the current sub-pixel data Cur1 are greater than (or equal to) the previous sub-pixel data Pre, the compensation calculation circuit 330 may increase the current sub-pixel data Cur1 by the function value FV to generate the compensated sub-pixel data Cur2 (i.e., Cur2=Cur1+FV). If the polarity POL is expressed as "negative polarity", and when the current sub-pixel data Cur1 are less than the previous sub-pixel data Pre, the compensation calculation circuit 330 may decrease the current sub-pixel data Cur1 by the function value FV to generate the compensated sub-pixel data Cur2 (i.e., Cur2=Cur1−FV).

Figure 5:
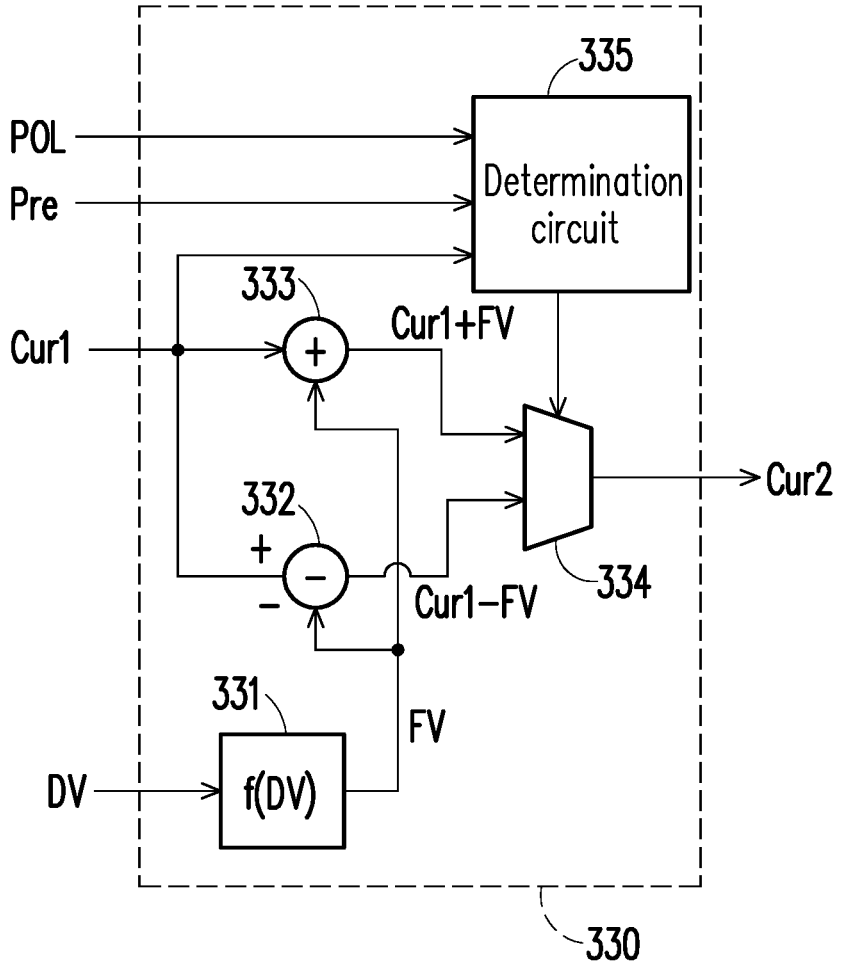
FIG. 5 is a schematic diagram illustrating a circuit block of the compensation calculation circuit shown in FIG. 3 according to an embodiment of the disclosure.

FIG. 5 is a schematic diagram illustrating a circuit block of the compensation calculation circuit 330 shown in FIG. 3 according to an embodiment of the disclosure. In the embodiment shown in FIG. 5, the compensation calculation circuit 330 includes a function calculation circuit 331, a subtraction circuit 332, an addition circuit 333, a selection circuit 334, and a determination circuit 335. The function calculation circuit 331 is coupled to the variance calculation circuit 320 to receive the difference value DV. The function calculation circuit 331 may convert the difference value DV to the function value FV. For instance, in some embodiments, the function calculation circuit 331 may look up one or more look-up tables set according to the design requirements by applying the difference value DV to obtain the function value FV. In other embodiments, the function calculation circuit 331 may substitute the difference value DV into one or more equations defined according to the design requirements (e.g., the above-mentioned equation 1, equation 2, or equation 3), so as to calculate the function value FV.

The subtraction circuit 332 and the addition circuit 333 are coupled to the function calculation circuit 331 to receive the function value FV. The subtraction circuit 332 may subtract the function value FV from the current sub-pixel data Cur1 to generate a subtraction result Cur1−FV. The addition circuit 333 is coupled to the function calculation circuit 331 to receive the function value FV. The addition circuit 333 may add the function value FV to the current sub-pixel data Cur1 to generate an addition result Cur1+FV. The selection circuit 334 is coupled to the subtraction circuit 332 and the addition circuit 333. The selection circuit 334 may dynamically select one of the subtraction result Cur1−FV and the addition result Cur1+FV as the compensated sub-pixel data Cur2.

The determination circuit 335 may control the selection circuit 334. The determination circuit 335 may also compare the current sub-pixel data Cur1 with the previous sub-pixel data Pre and check the polarity POL corresponding to the current frame period. For some display panels, the gate-source voltage Vgs of the TFT with the positive polarity may be lower than the gate-source voltage of the TFT with the negative polarity. Therefore, if the polarity POL is expressed as "positive polarity", and when the current sub-pixel data Cur1 are greater than (or equal to) the previous sub-pixel data Pre, the determination circuit 335 may control the selection circuit 334 to select the addition result Cur1+FV as the compensated sub-pixel data Cur2. When the polarity POL is expressed as "positive polarity", and when the current sub-pixel data Cur1 are less than the previous sub-pixel data Pre, the determination circuit 335 may control the selection circuit 334 to select the subtraction result Cur1−FV as the compensated sub-pixel data Cur2. When the polarity POL is expressed as "negative polarity", and when the current sub-pixel data Cur1 are greater than (or equal to) the previous sub-pixel data Pre, the determination circuit 335 may control the selection circuit 334 to select the subtraction result Cur1−FV as the compensated sub-pixel data Cur2. If the polarity POL is expressed as "negative polarity", and when the current sub-pixel data Cur1 are less than the previous sub-pixel data Pre, the determination circuit 335 may control the selection circuit 334 to select the addition result Cur1+FV as the compensated sub-pixel data Cur2.

For other display panels, the gate-source voltage Vgs of the TFT with the positive polarity may be greater than the gate-source voltage of the TFT with the negative polarity. Therefore, when the polarity POL is expressed as "positive polarity", and when the current sub-pixel data Cur1 are greater than (or equal to) the previous sub-pixel data Pre, the determination circuit 335 may control the selection circuit 334 to select the subtraction result Cur1−FV as the compensated sub-pixel data Cur2. If the polarity POL is expressed as "positive polarity", and when the current sub-pixel data Cur1 are less than the previous sub-pixel data Pre, the determination circuit 335 may control the selection circuit 334 to select the addition result Cur1+FV as the compensated sub-pixel data Cur2. If the polarity POL is expressed as "negative polarity", and when the current sub-pixel data Cur1 are greater than (or equal to) the previous sub-pixel data Pre, the determination circuit 335 may control the selection circuit 334 to select the addition result Cur1+FV as the compensated sub-pixel data Cur2. If the polarity POL is expressed as "negative polarity", and when the current sub-pixel data Cur1 are less than the previous sub-pixel data Pre, the determination circuit 335 may control the selection circuit 334 to select the subtraction result Cur1−FV as the compensated sub-pixel data Cur2.

Figure 6:
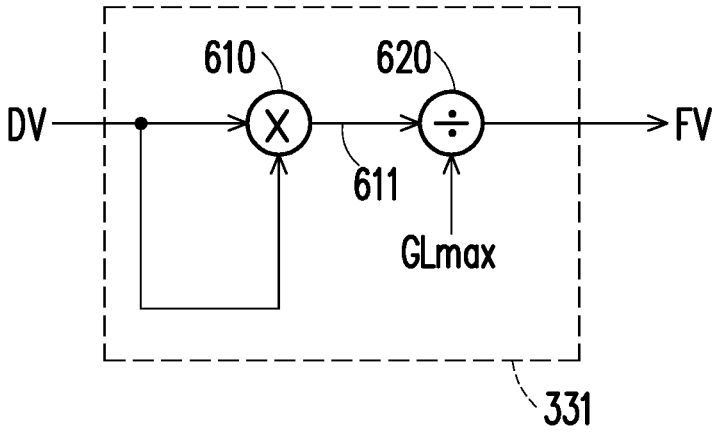
FIG. 6 is a schematic diagram illustrating a circuit block of the function calculation circuit shown in FIG. 5 according to an embodiment of the disclosure.

FIG. 6 is a schematic diagram illustrating a circuit block of the function calculation circuit 331 shown in FIG. 5 according to an embodiment of the disclosure. In the embodiment shown in FIG. 6, the function calculation circuit 331 includes a multiplication circuit 610 and a division circuit 620. The multiplication circuit 610 is coupled to the variance calculation circuit 320 to receive the difference value DV. The multiplication circuit 610 may multiply the difference value DV by the difference value DV to generate a multiplication result 611. The division circuit 620 is coupled to the multiplication circuit 610 to receive the multiplication result 611. The division circuit 620 may divide the multiplication result 611 by the grayscale resolution GLmax to generate the function value FV.

Figure 7:
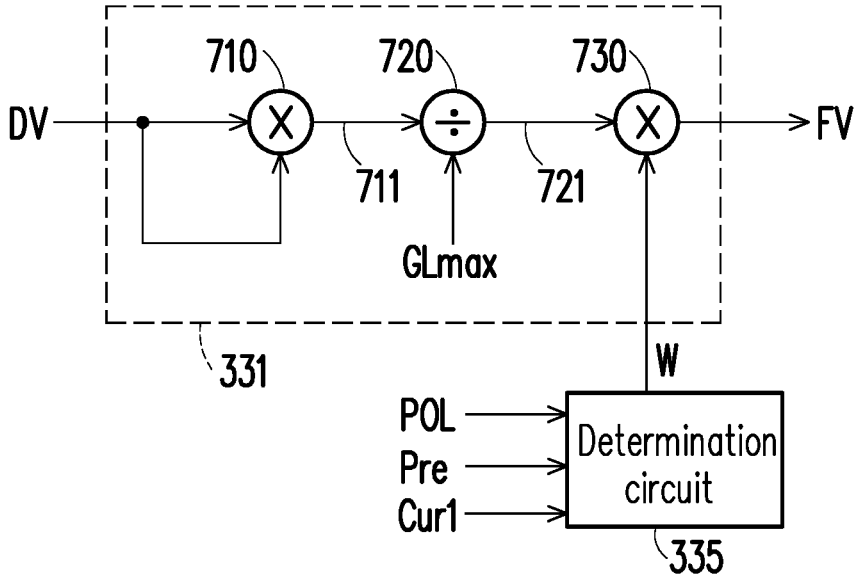
FIG. 7 is a schematic diagram illustrating a circuit block of the function calculation circuit shown in FIG. 5 according to another embodiment of the disclosure.

FIG. 7 is a schematic diagram illustrating a circuit block of the function calculation circuit 331 shown in FIG. 5 according to another embodiment of the disclosure. In the embodiment shown in FIG. 7, the function calculation circuit 331 includes a multiplication circuit 710, a division circuit 720, and a multiplication circuit 730. The multiplication circuit 710 is coupled to the variance calculation circuit 320 to receive the difference value DV. The multiplication circuit 710 may multiply the difference value DV by the difference value DV to generate a multiplication result 711. The division circuit 720 is coupled to the multiplication circuit 710 to receive the multiplication result 711. The division circuit 720 may divide the multiplication result 711 by the grayscale resolution GLmax to generate a division result 721. The multiplication circuit 730 is coupled to the division circuit 720 to receive the division result 721. The multiplication circuit 730 may multiply the division result 721 by the weight W to generate the function value FV.

The weight W may be provided by the determination circuit 335. The determination circuit 335 may compare the current sub-pixel data Cur1 and the previous sub-pixel data Pre to obtain the variation relationship. The variation relationship includes "the current sub-pixel data Cur1 are greater than previous sub-pixel data Pre" or "the current sub-pixel data Cur1 are less than previous sub-pixel data Pre". The determination circuit 335 may know the polarity POL corresponding to the current frame period. The determination circuit 335 may dynamically adjust the weight W according to the polarity POL and the variation relationship. For instance, in the case where the polarity POL is expressed as "positive polarity", the weight W can be set to a weight value W(P+L2H) when the current sub-pixel data Cur1 is greater than (or equal to) the previous sub-pixel data Pre. In the case where the polarity POL is expressed as "positive polarity", the weight W can be set to a weight value W(P+H2L) when the current sub-pixel data Cur1 is smaller than the previous sub-pixel data Pre. In the case where the polarity POL is expressed as "negative polarity", the weight W can be set to a weight value W(P−L2H) when the current sub-pixel data Cur1 is greater than (or equal to) the previous sub-pixel data Pre. In the case where the polarity POL is expressed as "negative polarity", the weight W can be set to a weight value W(P−H2L) when the current sub-pixel data Cur1 is smaller than the previous sub-pixel data Pre. The weight values W(P+L2H), W(P+H2L), W(P−L2H) and W(P−H2L) can be determined according to design requirements. For example, any one of the weight values W(P+L2H), W(P+H2L), W(P−L2H) and W(P−H2L) can be set as a real number from 0 to 2.

In some embodiments, the adjustment of the weight W may also be related to panel characteristics. For example, for some display panels, the gate-source voltage Vgs of the TFT with the positive polarity may be lower than the gate-source voltage Vgs of the TFT with the negative polarity. Therefore, the relationship between the weight values W(P+L2H) and W(P−L2H) may be "W(P+L2H)<W(P−L2H)", and the relationship between the weight values W(P+H2L) and W(P−H2L) may be "W(P+H2L)<W(P−H2L)". For example, the weight value W(P+L2H) may be 0.1, and the weight value W(P−L2H) may be 0.15. For another example, for some other display panels, the gate-source voltage Vgs of the TFT in the positive polarity may be greater than the gate-source voltage Vgs of the TFT in the negative polarity. Therefore, the relationship between the weight values W(P+L2H) and W(P−L2H) may be "W(P+L2H)>W(P−L2H)", and the relationship between the weight values W(P+H2L) and W(P−H2L) may be "W(P+H2L)>W(P−H2L)".

Figure 8:
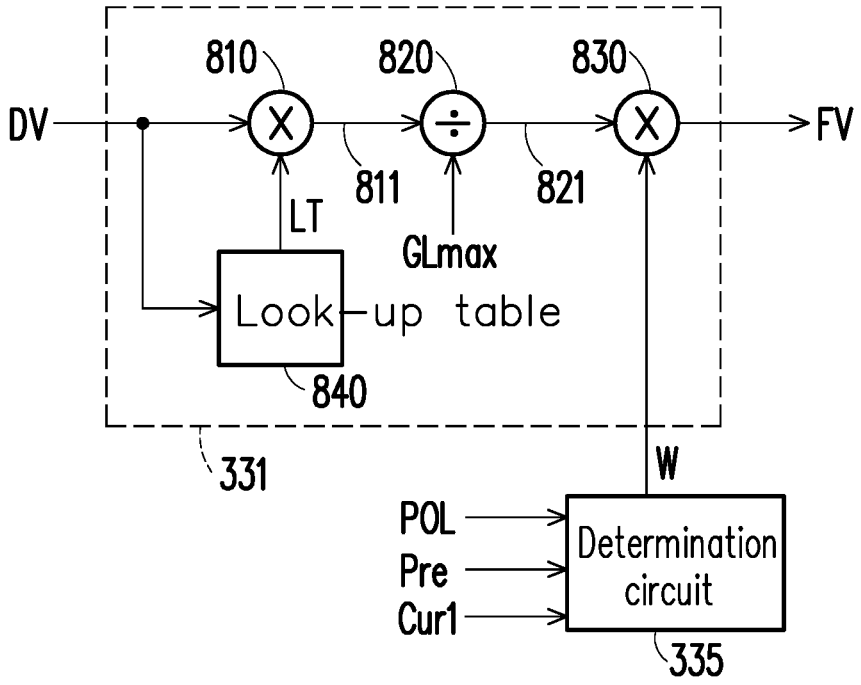
FIG. 8 is a schematic diagram illustrating a circuit block of the function calculation circuit shown in FIG. 5 according to another embodiment of the disclosure.

FIG. 8 is a schematic diagram illustrating a circuit block of the function calculation circuit 331 shown in FIG. 5 according to another embodiment of the disclosure. In the embodiment shown in FIG. 8, the function calculation circuit 331 includes a multiplication circuit 810, a division circuit 820, a multiplication circuit 830, and a look-up table 840. The look-up table 840 may be applied to obtain the look-up value LT according to the difference value DV. The look-up table 840 may be defined according to the design requirements. For instance, in some embodiments, the look-up value LT may be obtained from the look-up Table 1 according to the difference value DV.

The multiplication circuit 810 is coupled to the variance calculation circuit 320 to receive the difference value DV. The multiplication circuit 810 may multiply the difference value DV by the look-up value LT to generate a multiplication result 811. The division circuit 820 is coupled to multiplication circuit 810 to receive multiplication result 811. The division circuit 820 may divide the multiplication result 811 by the grayscale resolution GLmax to generate a division result 821. The multiplication circuit 830 is coupled to the division circuit 820 to receive the division result 821. The multiplication circuit 830 may multiply the division result 821 by the weight W to generate the function value FV. The weight W may be provided by the determination circuit 335.

According to different design requirements, the implementation of the blocks of the variance calculation circuit 320 and/or the compensation calculation circuit 330 may be in form of hardware, firmware, software (i.e., a program), or a combination thereof.

In terms of hardware, the blocks of the variance calculation circuit 320 and/or the compensation calculation circuit 330 may be implemented on a logic circuit of an integrated circuit. Relevant functions of the variance calculation circuit 320 and/or the compensation calculation circuit 330 may be implemented in form of hardware by applying hardware description languages (e.g., Verilog HDL or VHDL) or other suitable programming languages. For instance, the relevant functions of the variance calculation circuit 320 and/or the compensation calculation circuit 330 may be implemented in one or more controllers, microcontrollers, microprocessors, application-specific integrated circuits (ASIC), digital signal processors (DSP), field programmable gate arrays (FPGA), and/or various logic blocks, modules, and circuits in other processing units.

In terms of software and/or firmware, the relevant functions of the variance calculation circuit 320 and/or the compensation calculation circuit 330 may be implemented in form of programming codes. For instance, the variance calculation circuit 320 and/or the compensation calculation circuit 330 are implemented by applying general programming languages (e.g., C, C++, or assembly languages) or other suitable programming languages. The programming codes may be recorded/stored in a recording medium, and the recording medium may include a read only memory (ROM), a storage device, and/or a random access memory (RAM), for instance. A computer, a central processing unit (CPU), a controller, a microcontroller, or a microprocessor may read and execute the programming codes from the recording medium to achieve relevant functions. A "non-transitory computer readable medium", e.g., a tape, a disk, a card, a semiconductor memory, a programmable logic circuit, and so on, may serve as the recording medium. Moreover, the program may be provided to the computer (or the CPU) through any transmission medium (communication network, broadcast waves, and so forth). The communication network is, for instance, Internet, wired communications, wireless communications, or other communication media.

To sum up, in the polarity compensation device 300 and the polarity compensation method described in one or more embodiments provided above, the difference value DV of the current sub-pixel data Cur1 and the previous sub-pixel data Pre belonging to the same data line may be calculated. According to the difference value DV and the polarity POL, the compensation calculation circuit 330 may increase or decrease the current sub-pixel data Cur1 to generate the compensated sub-pixel data Cur2. Therefore, the polarity compensation device 300 may eliminate line sticking as much as possible.

It will be apparent to those skilled in the art that various modifications and variations can be made to the disclosed embodiment without departing from the scope or spirit of the disclosure. In view of the foregoing, it is intended that the disclosure covers modifications and variations provided that they fall within the scope of the following claims and their equivalents.

What is claimed is:

1. A polarity compensation device, comprising:

a variance calculation circuit, configured to calculate a difference value between current sub-pixel data and previous sub-pixel data in a same frame period, wherein the current sub-pixel data and the previous sub-pixel data belong to a same data line of a display panel; and a compensation calculation circuit, coupled to the variance calculation circuit to receive the difference value and configured to convert the difference value to a function value, wherein the compensation calculation circuit determines whether to increase or decrease the current sub-pixel data by the function value according to a polarity corresponding to the same frame period, so as to generate compensated sub-pixel data wherein the compensation calculation circuit converts the difference value to the function value by applying an equation $FV=|DV|*|DV|/GLmax$, wherein FV represents the function value, DV represents the difference value, and GLmax represents a grayscale resolution.

2. The polarity compensation device according to claim 1, wherein, when the polarity is a positive polarity, and when the current sub-pixel data are greater than or equal to the previous sub-pixel data, the compensation calculation circuit increases the current sub-pixel data by the function value to generate the compensated sub-pixel data;

when the polarity is the positive polarity, and when the current sub-pixel data are less than the previous sub-pixel data, the compensation calculation circuit decreases the current sub-pixel data by the function value to generate the compensated sub-pixel data;

when the polarity is a negative polarity, and when the current sub-pixel data are greater than or equal to the previous sub-pixel data, the compensation calculation circuit decreases the current sub-pixel data by the function value to generate the compensated sub-pixel data; and when the polarity is the negative polarity, and when the current sub-pixel data are less than the previous sub-pixel data, the compensation calculation circuit increases the current sub-pixel data by the function value to generate the compensated sub-pixel data.

3. The polarity compensation device according to claim 1, wherein the compensation calculation circuit comprises:

a function calculation circuit, coupled to the variance calculation circuit to receive the difference value and configured to convert the difference value to the function value;

a subtraction circuit, coupled to the function calculation circuit to receive the function value and configured to subtract the function value from the current sub-pixel data to generate a subtraction result;

an addition circuit, coupled to the function calculation circuit to receive the function value and configured to add the function value to the current sub-pixel data to generate an addition result; and a selection circuit, coupled to the subtraction circuit and the addition circuit and configured to dynamically select one of the subtraction result and the addition result as the compensated sub-pixel data.

4. The polarity compensation device according to claim 3, wherein the compensation calculation circuit further comprises:

a determination circuit, configured to control the selection circuit, wherein when the polarity is a positive polarity, and when the current sub-pixel data are greater than or equal to the previous sub-pixel data, the determination circuit controls the selection circuit to select the addition result as the compensated sub-pixel data;

when the polarity is the positive polarity, and when the current sub-pixel data are less than the previous sub-pixel data, the determination circuit controls the selection circuit to select the subtraction result as the compensated sub-pixel data;

when the polarity is a negative polarity, and when the current sub-pixel data are greater than or equal to the previous sub-pixel data, the determination circuit controls the selection circuit to select the subtraction result as the compensated sub-pixel data; and when the polarity is the negative polarity, and when the current sub-pixel data are less than the previous sub-pixel data, the determination circuit controls the selection circuit to select the addition result as the compensated sub-pixel data.

5. The polarity compensation device according to claim 3, wherein the function calculation circuit comprises:

a multiplication circuit, coupled to the variance calculation circuit to receive the difference value and configured to multiply the difference value by the difference value to generate a multiplication result; and a division circuit, coupled to the multiplication circuit to receive the multiplication result and configured to divide the multiplication result by a grayscale resolution to generate the function value.

6. A polarity compensation method, comprising:

calculating, by a difference calculation circuit, a difference value between current sub-pixel data and previous sub-pixel data in a same frame period, wherein the current sub-pixel data and the previous sub-pixel data belong to a same data line of a display panel;

converting, by a compensation calculation circuit, the difference value to a function value; and determining, by the compensation calculation circuit, whether to increase or decrease the current sub-pixel data by the function value according to a polarity corresponding to the same frame period to generate compensated sub-pixel data, wherein the step of converting the difference value to the function value comprises:

applying, by the compensation calculation circuit, an equation $FV|DV|*|DV|/GLmax$ to convert the difference value to the function value, wherein FV represents the function value, DV represents the difference value, and GLmax represents a grayscale resolution.

7. The polarity compensation method according to claim 6, wherein the step of determining whether to increase or decrease the current sub-pixel data by the function value comprises:

when the polarity is a positive polarity, and when the current sub-pixel data are greater than or equal to the previous sub-pixel data, increasing the current sub-pixel data by the function value to generate the compensated sub-pixel data by the compensation calculation circuit;

when the polarity is the positive polarity, and when the current sub-pixel data are less than the previous sub-pixel data, decreasing the current sub-pixel data by the function value to generate the compensated sub-pixel data by the compensation calculation circuit;

when the polarity is a negative polarity, and when the current sub-pixel data are greater than or equal to the previous sub-pixel data, decreasing the current sub-pixel data by the function value to generate the compensated sub-pixel data by the compensation calculation circuit; and when the polarity is the negative polarity, and when the current sub-pixel data are less than the previous sub-pixel data, increasing the current sub-pixel data by the function value to generate the compensated sub-pixel data by the compensation calculation circuit.

* * * * *